United States Patent [19]

Hendry et al.

[11] 3,975,701

[45] Aug. 17, 1976

[54] CIRCUIT BREAKER WITH ONE-WAY ADJUSTMENT OF TRIPPING CURRENT LEVEL

[75] Inventors: Allen J. Hendry, Beaver; Alfred E. Maier, Beaver Falls, both of Pa.

[73] Assignee: Westinghouse Electric Corporation, Pittsburgh, Pa.

[22] Filed: Oct. 10, 1974

[21] Appl. No.: 513,784

[52] U.S. Cl. ..... 335/176; 335/42; 337/57; 337/82; 337/94

[51] Int. Cl.[2] ..... H01H 71/74

[58] Field of Search ..... 335/176, 42, 105; 337/82, 57, 94

[56] References Cited

UNITED STATES PATENTS

| | | | |
|---|---|---|---|
| 3,240,903 | 3/1966 | Groves et al. | 337/82 |
| 3,593,234 | 7/1971 | Charbonneau et al. | 335/176 |

*Primary Examiner*—Harold Broome
*Attorney, Agent, or Firm*—R. E. Converse, Jr.

[57] ABSTRACT

A molded case circuit breaker having a solid-state trip unit adjustable over a variety of ratings. One-way adjustment is provided, permitting a reduction in the rating of the circuit breaker and preventing an increase in the rating. A ratchet mechanism and a one-way screw mechanism are provided to implement the one-way adjustment.

5 Claims, 5 Drawing Figures

CIRCUIT BREAKER WITH ONE-WAY ADJUSTMENT OF TRIPPING CURRENT LEVEL

BACKGROUND OF THE INVENTION

1. Field of the Invention

The invention relates in general to circuit breakers and more particularly to molded case circuit breakers having an adjustable rating.

2. Description of the Prior Art

Circuit breakers are widely used in commerce and industry to protect electrical apparatus from over-current conditions. The varying requirements of different applications require circuit breakers in a variety of ratings. Manufacturers and suppliers are thus required to produce and hold in inventory a large number of different types of circuit breakers. Considerable savings would result if a single circuit breaker could provide a variety of ratings.

Circuit breakers having adjustable ratings are described in U.S. Pat. No. 3,575,679 issued to James P. Ellsworth and John Zipay, assigned to the assignee of the present invention, and U.S. Pat. No. 3,593,234 issued to Allan P. Charbonneau. Circuit breakers described in the above-mentioned U.S. patents employ adjustment means having a variety of locking devices and biasing means to permit adjustment of the circuit breaker rating.

Safety problems can result however from a circuit breaker capable of covering a range of ratings. For instance, if a circuit breaker is properly adjusted and installed on a 200 ampere line, and conditions on the line cause repeated tripping, there is a natural human tendency to increase the tripping current level of the circuit breaker to prevent the nuisance of repeated trippings. This, of course, will result in a dangerous condition if the tripping current level of the circuit breaker is increased above 200 amperes. Thus, a compromise must be established between convenience and safety.

One answer in the past was to provide circuit breakers having interchangeable trip units. In order to change the rating of the circuit breaker the entire trip unit was removed in the field and a new trip unit of different rating installed. This was a complex procedure, however, and sometimes resulted in improper installation of the new trip unit. This in turn resulted in failure of the circuit breaker, causing extensive damage to the circuit breaker and to the apparatus being protected. Also, the problems associated with manufacturing and stocking a variety of unit ratings remained.

It would be desirable to provide a circuit breaker adjustable over a range to provide a variety of ratings which would avoid safety problems associated with adjustable circuit breakers, be of simple construction, and provide for convenient adjustment.

SUMMARY OF THE INVENTION

The invention provides a circuit breaker having separable contacts, a trip mechanism operable to effect automatic separation of the contacts when current flow through the contacts exceeds a tripping current level, and adjustment means to vary the tripping current level. The adjustment means permits adjustment of the circuit breaker so as to reduce the tripping current level and prevents adjustment to increase the tripping current level.

DESCRIPTION OF THE PREFERRED EMBODIMENTS

Figure 1:
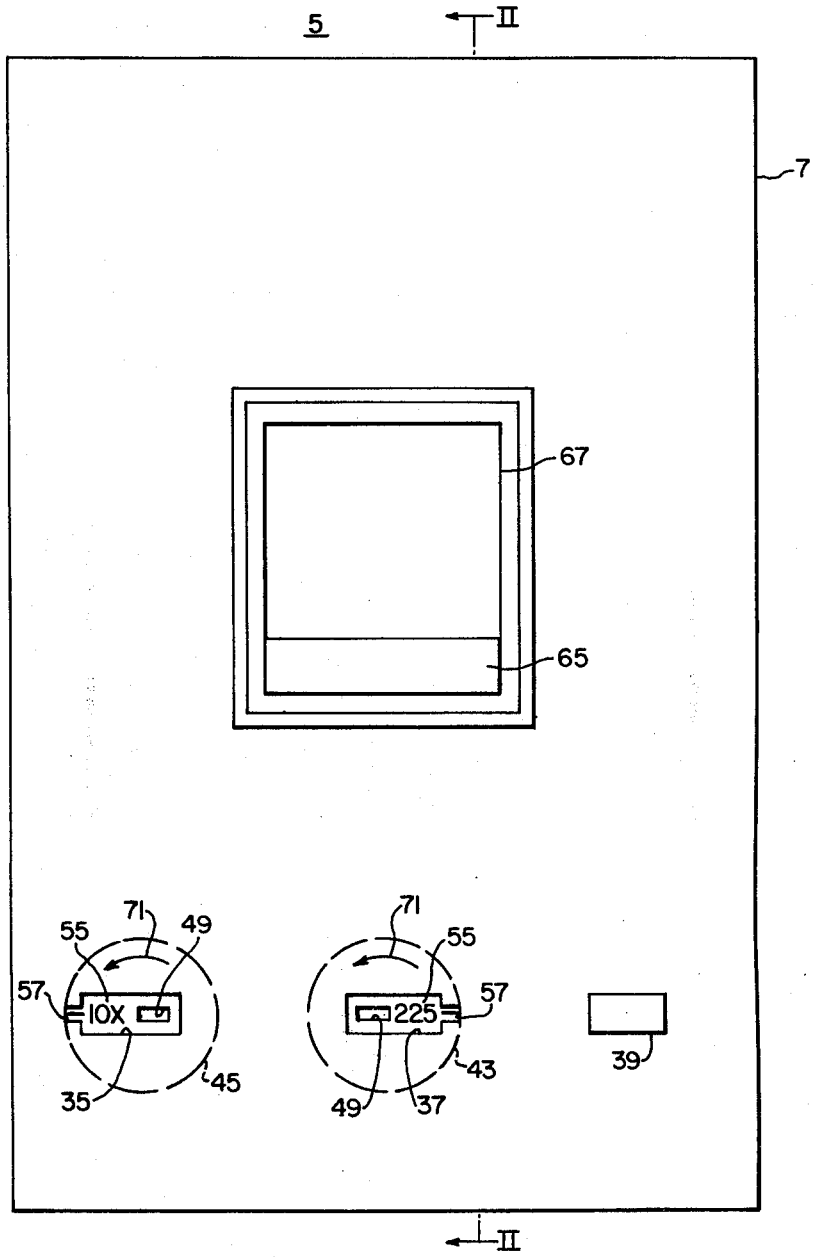
FIG. 1 is a top plan view of a molded case circuit breaker having a solid-state trip unit employing the principles of the present invention.

Throughout the drawings like reference characters refer to like members. Referring now to the drawings and FIG. 1 in particular, there is shown a plan view of a three-pole molded case circuit breaker 5 employing the principles of the present invention. The circuit breaker mechanism is more specifically described in U.S. Pat. No. 3,808,567 issued to Alfred E. Maier and assigned to the assignee of the instant application. Thus only a brief description of the circuit breaker mechanism is provided herein. The circuit breaker 5 comprises an insulating housing 7. An operating handle 65 extends through an opening 67 in the housing 7 and is operable to switch the circuit breaker between OPEN and CLOSED positions. Two slots 35 and 37 extend through the housing 7 at the lower end of the circuit breaker 5. Also extending through the lower end of the housing 7 is a manual trip pushbutton 39. Visible through the slots 35 and 37 are portions of an adjustable instantaneous trip knob 45 and an adjustable rating knob 43. These knobs are used to adjust the instantaneous trip level and the maximum continuous current rating, respectively, of the circuit breaker 5.

Figure 2:
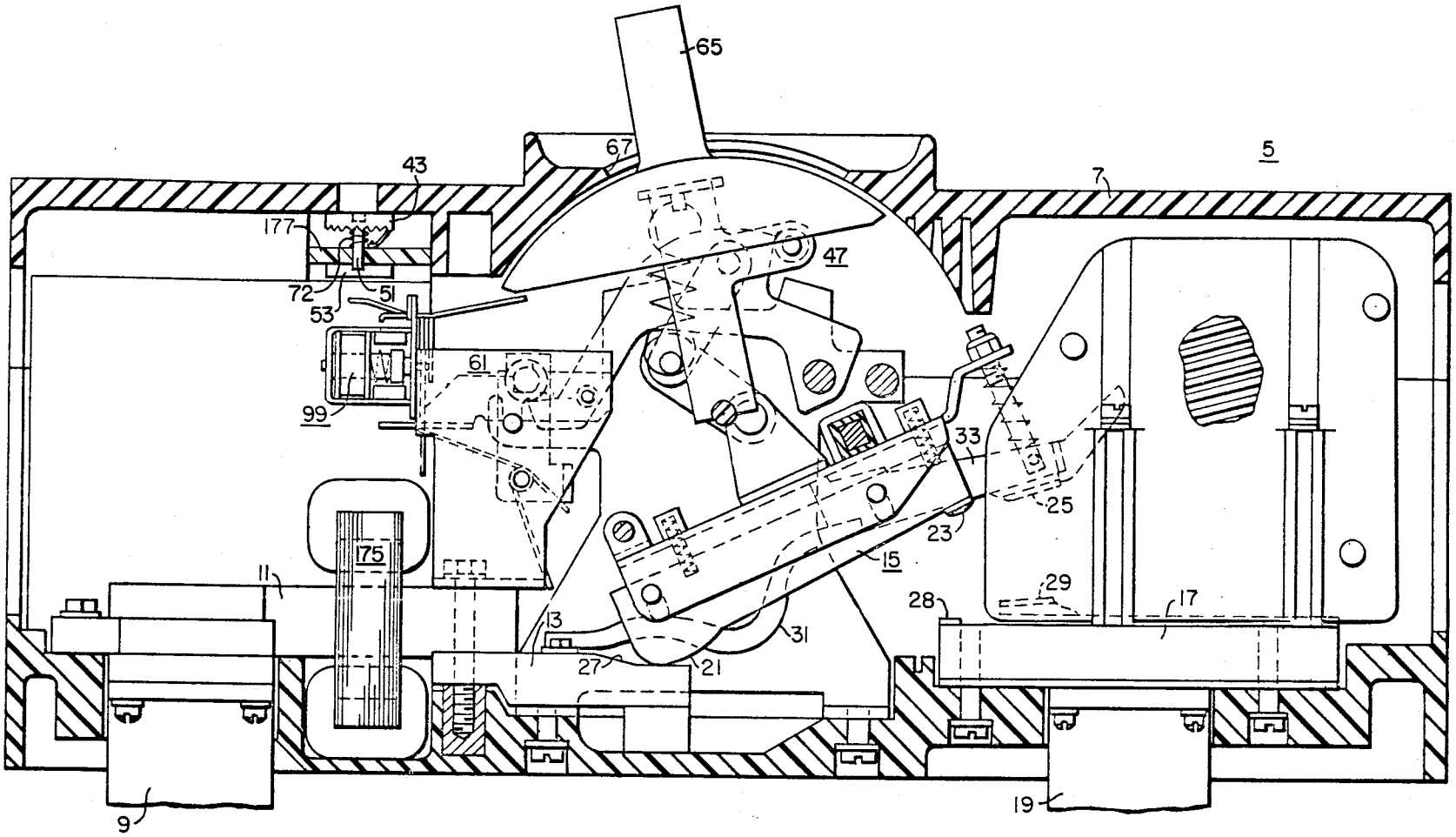
FIG. 2 is a sectional view of the circuit breaker shown in FIG. 1 taken along the line II—II.

FIG. 2 shows more clearly the operating mechanism 47 of the circuit breaker 5 in the open position. In the closed position of the circuit breaker, a circuit through each pole unit extends from a terminal 9 to a conductor 11, a conductor 13, a movable contact structure indicated generally at 15, a conductor 17, to another terminal 19. Contacts 21, 23, and 25 on the movable contact structure 15 cooperate with stationary contacts 27, 28, and 29 to bridge the conductors 13, 17 in the closed position of the movable contact structure 15. A flexible conductor 31 electrically connects the conductor 13 and a movable contact arm 33 that supports the arcing contacts 25. Operation of the handle 65 from its left-most position as shown in FIG. 2 to its right-most position actuates the operating mechanism 47 to close the contact structure 15. Corresponding movement of the handle 65 from its right-most position to its left-most position will actuate the operating mechanism 47 to raise the contact structure 15 and separate the contacts 21, 23, 25 on the movable contact structure from the stationary contacts 27, 28, and 29.

Figure 3:
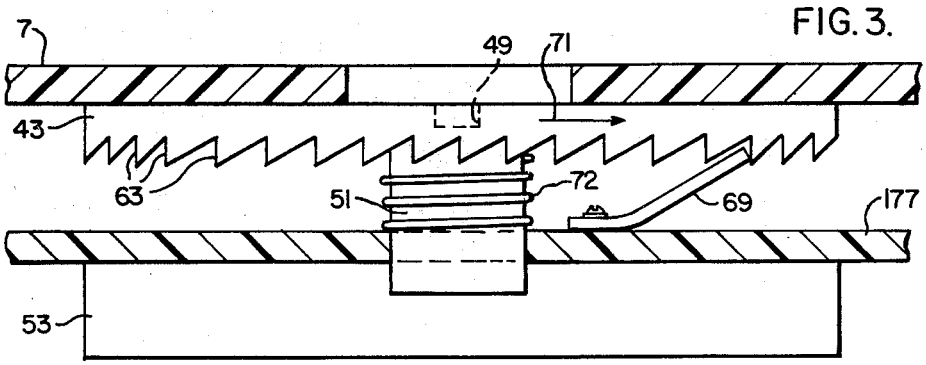
FIG. 3 is a detailed sectional view of the adjustable rating knob shown in FIG. 1 also taken along the line II—II.

A latch structure 61 serves to maintain the movable contact structure 15 in its closed position when the operating handle 65 is in its right-most position. A current monitor 175 surrounds the terminal 11 and senses an overcurrent condition through the circuit breaker 5. The current monitor 175 is connected to a solid-state trip circuit mounted upon a circuit board 177. Upon occurrence of an overload condition the solid-state trip circuit generates a tripping signal which is supplied to a flux transfer trip mechanism 99. Upon receipt of the tripping signal the flux transfer mechanism 99 causes the latch structure 61 to disengage, releasing the operating mechanism 47 and effecting automatic separation of the moving contacts 21, 23, 25 from the stationary contacts 27, 28, and 29. The flux transfer trip mechanism is described more fully in U.S. Pat. No. 3,783,423 issued to Alfred E. Maier and John A. Wafer, and assigned to the assignee of the present invention. The solid-state trip circuit mounted upon circuit board 177 is described more fully in pending application Ser. No. 47,311 (Westinghouse case 44,116) filed by Alan B. Shimp and Alfred E. Maier and assigned to the assignee of the present invention. As can be seen in FIG. 1, the instantaneous trip knob 45 and rating knob 43 each have slots 49 extending thereinto. These slots are adapted to receive the blade of screw driver or other tool and to be rotated by rotation of the screw driver blade. Each of the knobs 43 and 45 has a shaft 51, shown more clearly for the rating knob 43 in FIG. 3, extending through the circuit board 177 into potentiometers 53. Rotation of the knobs 41 and 43 causes rotation of the shafts 51 producing a variation in the setting of the potentiometers 53. This variation changes the operating conditions for the solid-state trip circuit mounted on the circuit board 177 and operates to adjust the maximum continuous current rating and instantaneous trip level of the circuit breaker. As can be seen in FIG. 1 legends 55 are inscribed on the obverse faces of the rating knob 43 and the instantaneous trip knob 45, the legend visible through the slot 35 indicating the level at which the circuit breaker is currently set. Precise positioning of the knobs 43 and 45 is aided by the marker lines 56 which can be centered in the indexing notches 57.

Compression springs 72 encircle the shafts 51 of the knobs 43 and 45, biasing the knobs 43 and 45 against the inner surface of the insulating housing 7. Stop members within the potentiometers 53 define the limits of travel for the adjusting knobs 43 and 45.

Referring once again to FIG. 3 it can be seen that the reverse side of the rating knob 45 includes a plurality of teeth 63. The instantaneous trip level knob 45, not shown in FIG. 3, can also have a similar plurality of teeth. A resilient leaf spring member 69 is mounted upon the circuit board 177 and biased into engagement with the reverse side of the knob 43. As can be seen the resilient leaf spring member 69 and teeth 63 provide ratchet action permitting rotation of the rating knob 43 in the direction indicated by the arrow 71 in FIGS. 1 and 3 and preventing rotation of the knob 43 in the opposite direction.

During assembly, the rating knobs 43 and 45 are set to the highest rating and are shipped in this condition. When installed by an electrician in the field the knobs 43 and 45 are set by him to the level appropriate to the cables and associated electrical apparatus being connected to the circuit breaker 5. Thus a single circuit breaker can be used in applications requiring many different ratings. The one-way adjustment action of the knobs 43 and 45 avoids the safety problems of adjustable circuit breakers of the prior art by assuring that once the circuit breaker is initially set to the rating appropriate to the current handling capabilities to the circuit to which it is connected, it cannot be subsequently set to a higher rating. It can however be easily adjusted to a lower rating if that should later prove necessary.

Figure 4:
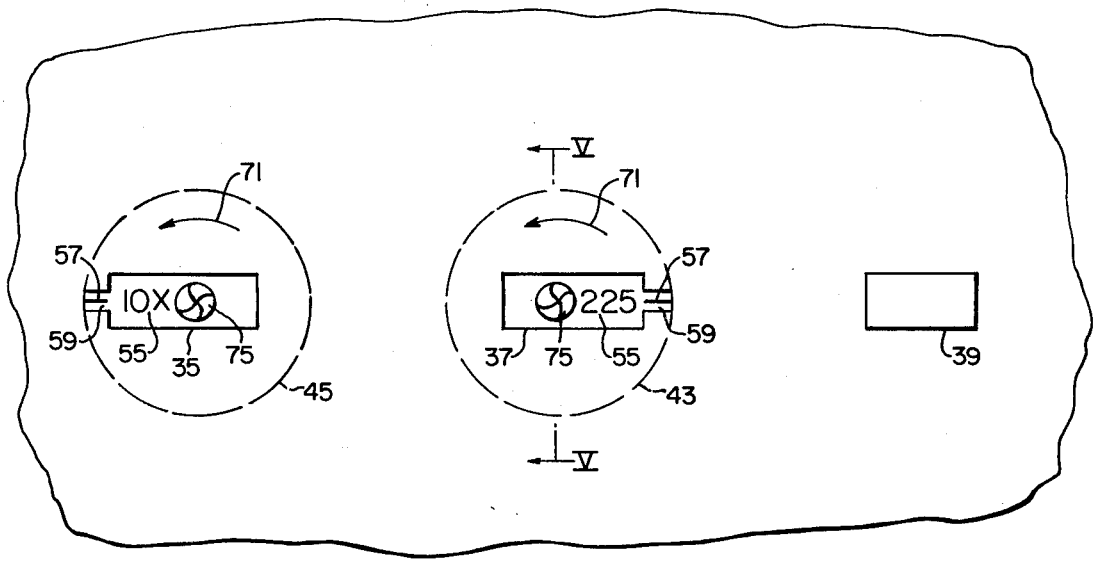
FIG. 4 is a partial top plan view of an alternative embodiment of the invention.
Figure 5:
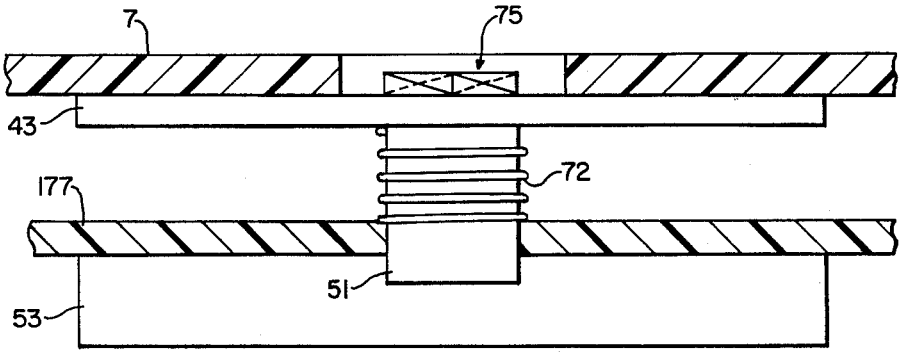
FIG. 5 is a detailed sectional view of the embodiment shown in FIG. 4 taken along the line V—V.

An alternative embodiment of the invention is shown in FIGS. 4 and 5. In place of the slots 49 the knobs 43 and 45 have molded on the obverse side a one-way screw head 75. As is well known in the art, a one-way screw head includes a plurality of surfaces perpendicular to the plane of rotation of the screw head and a plurality of surfaces inclined at an angle to the plane of rotation of the screw head. When the blade of a screw driver or other tool is pressed against the one-way screw head and rotated in a counterclockwise direction as seen in FIG. 4 the blade engages the perpendicular faces of the one-way screw head. Rotation of the screw driver in a counterclockwise direction thereby causes rotation of the one-way screw head. If the screw driver blade is rotated in a clockwise direction as seen in FIG. 4, however, the screw driver blade slides upward over the angled faces and out of engagement with the one-way screw head, thereby preventing rotation of the one-way screw head in a clockwise direction.

Counterclockwise rotation of the one-way screw head 74 molded into the knobs 43 and 45 causes counterclockwise rotation of the knobs 43 and 45, thereby causing adjustment of the potentiometers 53. Counterclockwise adjustment of the potentiometers 53 changes the operating conditions of the solid-state trip circuit, thereby reducing the tripping current level of the circuit breaker. Since the one-way screw head prevents clockwise rotation of the knobs 43 and 45 and the potentiometers 53, the operator is prevented from increasing the tripping current levels for the circuit breaker. Thus, one-way adjustment of the circuit breaker is provided by the described alternative embodiment of the invention.

The invention is not limited to circuit breakers employing solid-state trip circuits in their tripping mechanism. The shafts 51 of the knobs 43 and 45 could be coupled mechanically in a well-known manner to the adjustment means provided, for example, in the trip mechanisms described in the above-mentioned U.S. Pat. Nos., 3,575,679 and 3,593,234.

Although specific embodiments of the invention described have included ratchet means and a one-way screw head, it will be apparent to one skilled in the art that various other mechanical arrangements may be implemented as alternative embodiments to provide a circuit breaker with one-way adjustment to reduce the tripping current level and prevent adjustment to increase the tripping current level.

In summary, there has been disclosed a new and improved circuit breaker suitable for use in a variety of applications requiring different circuit breaker ratings. Thus the number of different types of circuit breakers required to be manufactured and stocked to serve these various applications is reduced, thereby reducing the costs of the manufacturer and distributor. By providing a one-way adjustment of the tripping current level of the circuit breaker, the safety problems associated with prior art adjustable circuit breakers and circuit breakers having interchangeable trip mechanisms are avoided.

We claim:

1. A circuit breaker comprising:

a housing;

separable contacts;

trip means operable to effect automatic separation of said contacts when current flow through said contacts is equal to or above a predetermined tripping current level, said contacts and said trip means being supported within said housing; and adjustment means coupled to said trip means for varying said tripping current level, said adjustment means permitting adjustment to reduce said tripping current level and preventing adjustment in any manner which results in an increase in said tripping current level.

2. A circuit breaker as described in claim 1 wherein said adjustment means comprises resilient limit means preventing operation of said adjustment means in any manner which results in an increase in said tripping current level.

3. A circuit breaker as described in claim 2 wherein said adjustment means comprises a rotatable knob having a plurality of teeth and said resilient limit means comprises a resilient leaf spring member biased into engagement with said teeth so as to permit rotation of said knob in one direction only.

4. A circuit breaker comprising;

a housing;

separable contacts;

trip means operable to effect automatic separation of said contacts upon current flow through said contacts above a first level, said contacts and said trip means being supported within said housing; and one-way adjustment means coupled to said trip means for varying to a second level the current flow required to operate said trip means, said second level being lower than said first level.

5. A circuit breaker as described in claim 4 wherein said one-way adjustment means comprises a rotatable one-way screw head, said one-way screw head having a slot to receive a tool and adapted to engage the tool when the tool is rotated in a first direction and to prevent engagement of a tool when the tool is rotated in the direction opposite the said first direction.

* * * * *